US005383709A

United States Patent [19]

Chaney et al.

[11] Patent Number: 5,383,709

[45] Date of Patent: Jan. 24, 1995

[54] ORTHOPEDIC CHAIR WITH FORWARDLY AND REARWARDLY INCLINED POSITIONS

[75] Inventors: David B. Chaney; Joseph A. Koncelik, both of Powell, Ohio

[73] Assignee: Zoetech, Inc., Westerville, Ohio

[21] Appl. No.: 984,956

[22] Filed: Dec. 3, 1992

[51] Int. Cl.[6] ..... A47C 3/00

[52] U.S. Cl. ..... 297/302; 297/327

[58] Field of Search ..... 297/300–303, 297/304, 305, 325–327, 344.1, 452.21, 264, 258, 270

[56] References Cited

U.S. PATENT DOCUMENTS

| | | | |
|---|---|---|---|
| 202,576 | 4/1878 | Otto | 297/303 X |
| 2,689,599 | 9/1954 | Mauser | 297/303 X |
| 3,494,663 | 2/1970 | Flint | 297/354 |
| 3,866,973 | 2/1975 | Heubeck | 297/316 |
| 3,926,472 | 12/1975 | Evans | 297/88 |
| 3,950,026 | 4/1976 | Van Seenus | 297/328 |
| 4,123,102 | 10/1978 | Landry et al. | 297/270 |
| 4,214,790 | 7/1980 | Sieber | 297/326 |
| 4,533,177 | 8/1985 | Latone | 297/301 |
| 4,647,066 | 3/1987 | Walton | 280/657 |
| 4,707,026 | 11/1987 | Johansson | 297/270 X |
| 4,732,423 | 3/1988 | Condon | 297/284 |
| 4,778,217 | 10/1988 | Lane | 297/334 |
| 4,907,303 | 3/1990 | Baird | 4/480 |
| 4,930,842 | 6/1990 | Wilkinson et al. | 297/466 |

FOREIGN PATENT DOCUMENTS

| | | | |
|---|---|---|---|
| 0496862 | 11/1950 | Belgium | 297/302 |
| 0066359 | 6/1943 | Norway | 297/303 |
| 0669181 | 4/1945 | Norway | 297/303 |
| 0217011 | 6/1924 | United Kingdom | 297/303 |
| 0386838 | 1/1933 | United Kingdom | 297/303 |

*Primary Examiner*—James R. Brittain
*Assistant Examiner*—Milton Nelson, Jr.
*Attorney, Agent, or Firm*—Porter, Wright, Morris & Arthur

[57] ABSTRACT

A mobility chair is provided with a pair of mounting members projecting downwardly from armrests on opposite lateral sides of a seat frame approximately midway between a front end of the seat frame and a back frame. The mounting members are pivotally connected to supports extending upwardly from a chassis so that the user-receiving frame moves between forwardly inclined and rearwardly inclined positions. A gas cylinder extends between the chassis and the frame and prevents the angular movement of the frame from accelerating. The pivotal connections between the mounting members and the support members are disposed below the seat. In a restraining chair, the mounting members are disposed on opposite lateral sides of the seat substantially closer to the front end of the seat than to the back, and the pivotal connections between the mounting members and the support members are adjacent to the seat. The gas cylinder extends between the support members and the back of the frame and is adapted to urge the restraining chair towards the forwardly inclined position.

21 Claims, 4 Drawing Sheets

ORTHOPEDIC CHAIR WITH FORWARDLY AND REARWARDLY INCLINED POSITIONS

BACKGROUND OF THE INVENTION

This invention relates to orthopedic chairs and couches and, more particularly, to such seating adapted to move between reclined, upright and forwardly inclined positions.

In the past, orthopedic chairs designed to assist the user in moving between seated and standing positions typically included a tiltable seat whose rear portion moved upwardly relative to the back and armrests of the chair. Examples are disclosed in U.S. Pat. No. 4,907,303 to Baird and U.S. Pat. No. 4,778,217 to Lane. One of the perceived drawbacks to the chairs disclosed in these patents is their tendency to cause the user to stand or sit while his center of gravity is still shifting. Controlled tilting of the seat disclosed in Lane depends upon the user's ability to shift his weight between torso and legs in a balanced manner. If the user is unsteady and shifts his weight too far back or forward on the seat, pivotal movement of the seat would accelerate unless the user recovers his balance or the seat reaches a stopping point at a fully tilted or fully horizontal position. If either of these stops is reached suddenly, the user would be jarred into either a seated or standing position. The seat on Baird's orthopedic chair is pivotally connected to the frame at its front edge, so it is impossible for the user to control the movement of the seat simply by shifting his weight. Instead, Baird provides springs which serve as counterforces to the user's weight in moving the chair between horizontal and tilted positions. Even if the counterforce exerted by the springs is perfectly adjusted to accommodate a heavier or lighter user, an unintended shift in the user's weight during the raising or lowering movement could easily drive the seat to its upper or lower limit so rapidly as to destabilize and/or upset the user. In addition, the front edge of the Baird seat does not lower, so entry into, and exit from, the seat tends to require the user to be, or to place the user in, a relatively erect, straight-legged position.

Reclining orthopedic chairs have also been devised, but have lacked means to tilt forwardly in a manner which would aid the user in moving between seated and standing positions. The reclining chair disclosed in U.S. Pat. No. 4,732,423 to Condon is exemplary of this type. Although the seating assembly is pivotally mounted on a wheeled frame, a gas-hydraulic cylinder is so positioned below the seat as to prevent the seat from reaching a forwardly inclined position to any substantial degree. In addition, the pivot point on the Condon chair is disposed so far rearwardly that, even if the chair were capable of forward tilting, there would not be sufficient elevation of the rear portion of the seat to assist the user with ingress and egress. Furthermore, Condon's gas/-hydraulic cylinder acts as a brake or a positioning device rather than as a means of assisting and/or damping pivotal movement.

Thus, the present inventors were faced with the problem of devising an orthopedic chair adapted to be reclined and to be tilted forwardly in such a manner as to assist the user in moving safely and easily between seated and standing positions.

SUMMARY AND OBJECTS OF THE INVENTION

The present invention substantially reduces or overcomes the aforementioned drawbacks of the prior art by providing a seating assembly which basically comprises a floor-engaging chassis having a pair of laterally spaced apart, upwardly extending supports; a user-receiving frame having a seat, a back and a pair of laterally spaced apart mounting members; and at least one damping component extending between the frame and the chassis. The mounting members are adapted to be pivotally mounted upon the upwardly extending supports of the chassis and are positioned to permit the frame to move between forwardly inclined, level and rearwardly inclined positions in such a manner that a front portion of the seat is lower in the forwardly inclined position than in the level position, and the back is higher in the forwardly inclined position than in the level position. The damping component limits acceleration of the frame as it moves from one position to another.

One of the primary objects of the present invention is to provide an orthopedic seat or couch which assists the user in moving between seated and standing positions. Another primary object of the present invention is to provide a seating assembly that moves between forwardly tilted, level and reclined positions in a controlled manner, regardless of the position or movement of the user thereon. A further object of the present invention is to provide assistance in moving the subject seating assembly in one direction and resistance to movement in the opposite direction. Yet another object of the present invention is to provide an orthopedic chair having seat, back, and armrest portions which are forwardly and rearwardly inclinable as a unit. The foregoing objects and advantages, as well as others, may be more readily understood and appreciated in view of the following drawings and detailed description.

DETAILED DESCRIPTION OF THE PREFERRED EMBODIMENTS

Figure 1:
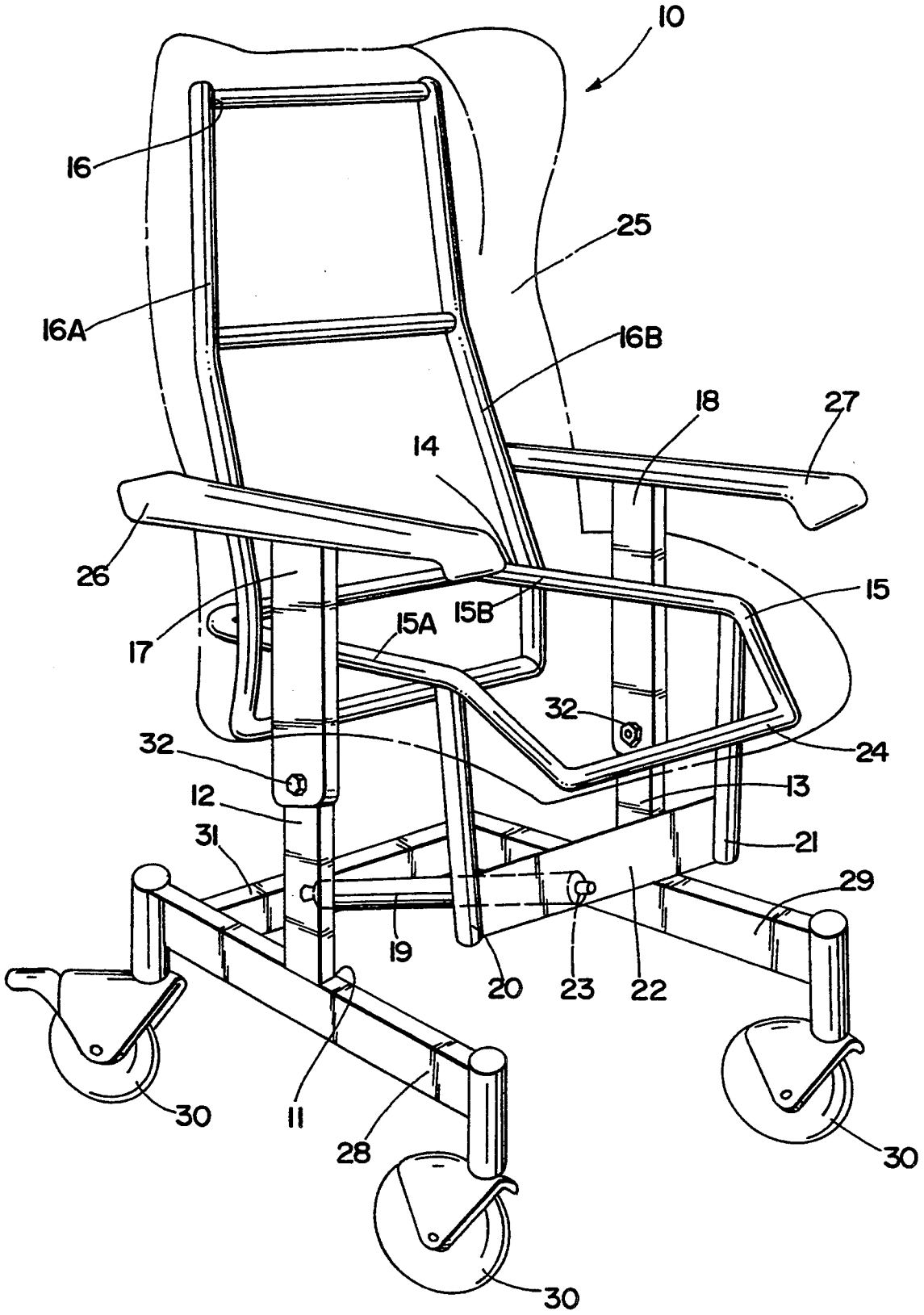
FIG. 1 is a perspective view of an orthopedic chair according to the present invention which is adapted for relatively ambulatory users ("mobility chair") and which is disposed in a relatively level position.
Figure 2:
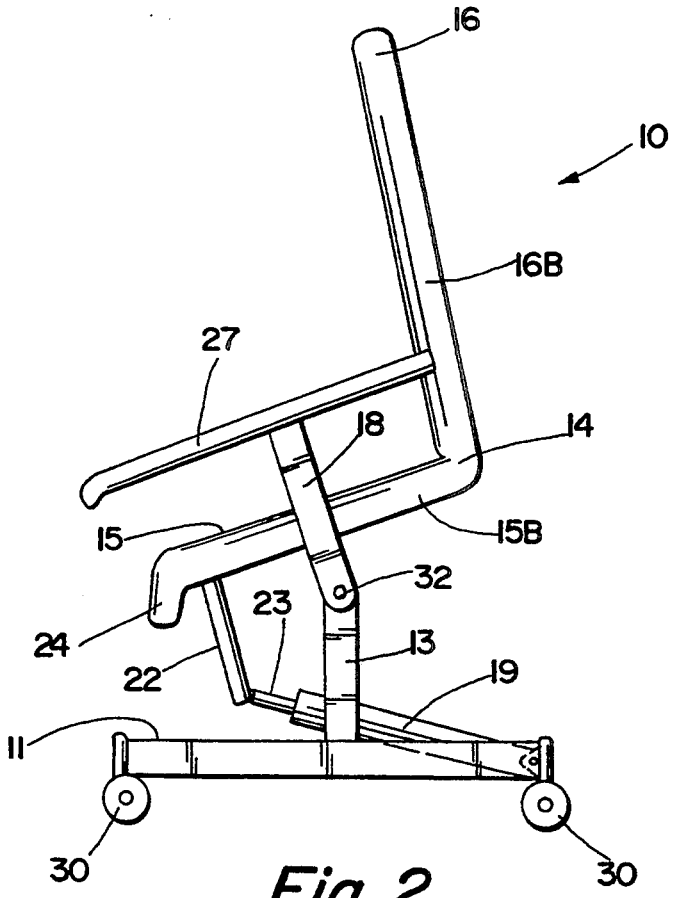
FIG. 2 is a diagrammatic, side elevational view, on a reduced scale, of the mobility chair illustrated in FIG. 1 and disposed in a forwardly inclined position.
Figure 3:
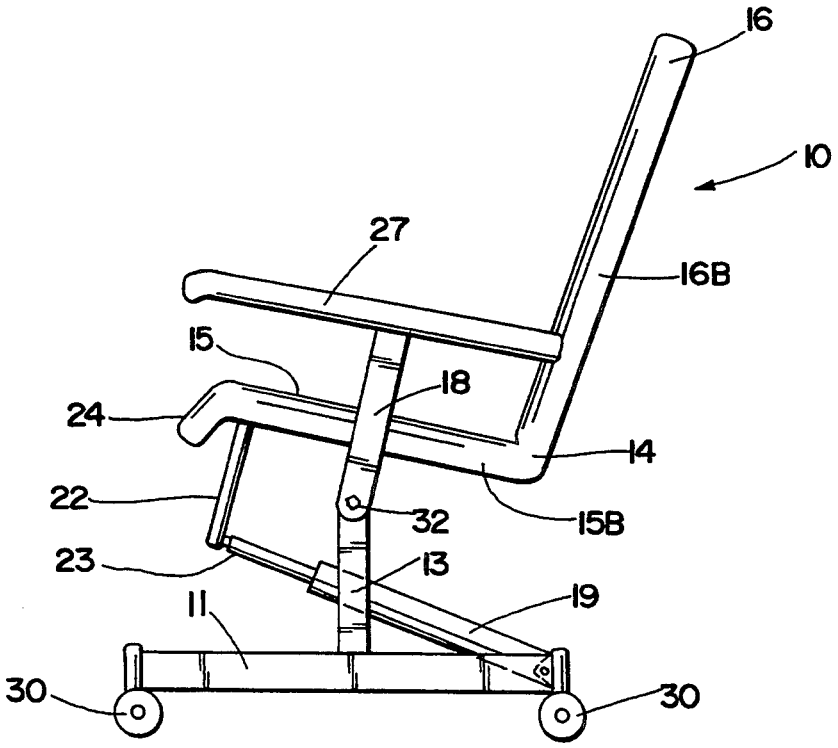
FIG. 3 is a side elevational view similar to FIG. 2, with the mobility chair disposed in a reclined position.

As indicated in FIGS. 1–3, the present invention may take the form of an orthopedic chair, generally designated 10, adapted for relatively ambulatory and mentally oriented users ("mobility chair"). The mobility chair 10 basically comprises a floor-engaging chassis 11 having a pair of laterally spaced apart, upwardly extending supports 12, 13; a user-receiving frame 14 having a seat 15, a back 16 and a pair of laterally spaced apart mounting members 17, 18; and a gas cylinder 19 extending between the frame 14 and the chassis 11. The frame 14 also includes a pair of laterally spaced apart struts 20, 21 projecting downwardly from the seat 15 and a brace 22 extending laterally between and connecting the lower ends of the struts 20, 21. A piston 23 is mounted in the gas cylinder 19 for longitudinally directed, reciprocative movement therein. An outer end of the piston 23 is pivotally connected in a conventional manner to the brace 22. The seat 15, back 16 and struts 20, 21 of the frame 14 are preferably formed from tubular aluminum alloy, although the use of molded synthetic resin to form the present frame structure is also contemplated. The seat 15 preferably includes a relatively downturned front portion 24. The downturned front portion 24 facilitates ingress and egress from the mobility chair in a manner described herein. The back 16 includes a pair of laterally spaced apart, upwardly extending frame members 16A and 16B which are attached to a pair of laterally spaced apart seat frame members 15A and 15B, respectively.

Orthopedically contoured cushioning material and a fabric covering 25 are removably mounted on the back 16 and seat 15 in a manner well known in the art. Webbing (not shown) extending between the laterally spaced apart seat members 15A, 15B and back members 16A, 16B may be provided in the usual manner to support the cushioning material and fabric cover 25.

A pair of armrests 26 and 27 are connected in central regions thereof to the mounting members 17 and 18, respectively. Rear portions of the armrests 26 and 27 are fastened to upwardly extending, laterally spaced apart back frame members 16A and 16B, respectively. The position of the back 16 may be fixed relative to the seat 15, armrests 26, 27 and mounting members 17, 18 by welding or otherwise rigidly fastening the foregoing components together. Alternatively, the back 16 may be pivotally connected to the seat 15 and the armrests 26, 27 may be movably mounted on the support members 17, 18 so that the angular relationship between the back 16 and the seat 15 may be adjusted. In addition, the laterally spaced apart seat frame members 15A and 15B may be connected to the mounting members 17 and 18, respectively, to provide additional support.

The mounting members 17, 18 are disposed on opposing lateral sides of the seat 16 roughly halfway between the downturned front portion 24 and the back 16. It is also possible, however, to fashion the present mobility chair 10 so that the support members 17, 18 are more forwardly or rearwardly disposed relative to the seat 15. By doing so, the mobility chair 10 would be biased toward either a forwardly or rearwardly inclined position, as described in further detail herein. However, by positioning the mounting members 17, 18 approximately centrally between the back 16 and downturned seat front 24, the height of the back 16 and adjacent rear portion of the seat 15 is maximized and the height of the downturned seat front 24 is minimized when the mobility chair is in a forwardly inclined position. This arrangement is believed to facilitate the user's movement between seated and standing positions.

It is also contemplated that the mobility chair 10 may be provided with optional features not shown in the drawing, such as an adjustable and/or fold down foot rest or a retractable leg-supporting extension mounted on the downwardly projecting struts 20, 21 or the brace 22.

The floor-engaging chassis 11 includes a pair of laterally spaced apart rails 28, 29 upon which casters or wheels 30 are pivotally mounted. A beam 31 extends transversely between and is rigidly connected to rearwardly disposed positions of the rails 28,29. Advantageously, the forwardly disposed portions of the rails 28,29 remain open so as not to interfere with the forward tilting movement of the frame 14 or with the user as he or she moves between standing and seated positions. The gas cylinder 19 is pivotally connected at its base to the transverse beam 31.

Preferably, the chassis 11 is formed from cast aluminum. The support members 12 and 13 are rigidly secured to and project upwardly from central portions of the elongated rails 28 and 29, respectively. Upper ends of the support members 12 and 13 extend slightly into lower hollow ends of the mounting members 17 and 18, respectively. Bolts or pins 32 extend through aligned bores formed in the relatively telescoping portions of the support members and mounting members, and sufficient space is provided between the relatively telescoping portions to permit pivotal movement of the mounting members 17, 18 on the support members 12,13.

The pivotal connections between the support members and mounting members are disposed below major portions of the seat frame members 15A and 15B. In this manner, there is a substantially greater horizontal vector to the arcuate movement of the user-receiving frame than would exist were the pivotal connections between the support members 12,13 and the mounting members 17,18 disposed at or above the level of the seat frame members 15A, 15B. It is believed that the ability of the user-receiving frame 14 to move forwardly, as an adjunct to its ability to be inclined, assists the user in moving between seated and standing positions.

The gas cylinder 19 is provided to limit the acceleration of the user-receiving frame 14 as said frame moves between forwardly inclined, level and rearwardly inclined positions. In addition to the foregoing damping effect in opposite directions, the subject gas cylinder 19 may be constructed so as to serve as a spring which assists the user in moving in one direction or the other. In this case, a triggering mechanism may be provided to activate the spring function. For example, a hand-operated lever (not shown) may be mounted upon one of the arm rests 26,27 or mounting members 17,18, a valve (not shown) provided on the proposed gas spring and a cable (not shown) may be provided to connect the valve and lever together. Examples of a gas spring and associated control components are disclosed in U.S. Pat. No. 4,732,423 to Condon. By employing such an assembly, it would be possible to assist the user in moving the mobility chair from a forwardly inclined position to a rearwardly inclined position. Alternatively, by changing the manner in which the gas spring is connected to the frame 14 and chassis 11, or by altering the gas spring so that it is loaded when the piston 23 is extended, it could assist the user in moving the chair out of the reclined positions. It is the present inventors'to intention, however, that both the gas cylinder and the gas spring limit acceleration of the user-receiving frame in each direction as it moves between forwardly inclined, level and rearwardly inclined positions.

The manner in which the user enters the present mobility chair 10 is as follows: First, the subject chair is placed in a forwardly inclined position that is comfortable to the user. The chair may be tilted forwardly by pushing down on the armrests 26,27 or the forward seat portion 24, or by pushing upwardly and forwardly on the back 16. Preferably, the chair is balanced by positioning the mounting members 17,18 midway between the front seat portion 24 and the back 16. In this manner, the frame 14 will remain in the selected forwardly inclined position as a result of the above-described balance and the resistance provided by the gas cylinder 19. Next, the user simply backs up to the chair so that the backs of his or her legs touch the downturned front seat portion 24 at a position which feels suitable for the individual to begin bending movement preliminary to reaching a seated position. Additional adjustment of the angle of the frame may be made by the user by applying a relatively small amount of upward or downwardly directed pressure to the handrests. The armrests 26,27 are inclined in substantially the same manner as the seat 15, and are relatively long so that the user can reach them without turning around or leaning rearwardly. Thus, they are fairly accessible to the user, even though they may not be entirely in view while the user is facing forwardly. Some users may find it helpful to tilt the chair forwardly until the seat 14 is as close as possible to the torso. This approach may be helpful to individuals with back problems which limit the ability to bend at the waist while in a standing position. In any event, it is believed that the substantial forward component to the movement of the frame into a forwardly inclined position, which is attributable to the relatively low pivot points, results in easier ingress.

After selecting a suitable forwardly inclined position, the user bends the knees until the torso engages the seat 15, whereupon the user shifts some of the weight from the feet to the torso. This weight-shifting process may be as gradual or as rapid as the user desires and results in the frame 14 moving from a forwardly inclined position towards a generally level position wherein the seat 15 is generally horizontally disposed. If a gas spring is employed, this movement can occur even if the user is positioned so far forwardly on the seat 15 that the center of gravity is forward of the mounting members 17,18. All that is required is release of the gas spring with the hand lever. If the gas cylinder 19 illustrated in FIGS. 1–3 is employed without incorporating a spring or other biasing device therein, it is incumbent upon the user to position the torso and/or shift weight forwardly or rearwardly on the seat 15 in order to move the present mobility chair 10 between its various positions. When the mounting members 17, 18 are centrally located, as illustrated, the user can move the chair into and maintain a desired position with relatively small weight shifts. If a reclined position is desired, the user shifts his weight rearwardly by leaning back in the chair, by sitting as far back as possible, or by a combination of these movements. The user may accomplish these movements either rapidly or slowly; in either event, the movement of the chair to a reclined position is controlled by the gas cylinder 19. The subject gas cylinder prevents the chair from accelerating beyond an angular velocity which is so low that, upon reaching the fully reclined position, the user is not jarred or upset.

When the user desires to return to a level or upright position, or to a standing position, he or she may lean forwardly, or shift to a more forward position on the seat. This forward movement occurs at a very low angular velocity, due to the damping effect of the cylinder 19, even if the user's center of gravity is well forward of the mounting members 17,18. The movement of the frame 14 into a forwardly inclined position is so gradual that the user can control it by leaning backward or forward, or by shifting his or her torso forwardly or rearwardly. If the user desires to exit the chair, he or she permits the chair to move into a forwardly inclined position that allows the user's feet to touch the ground while the user's weight is still substantially carried by the seat 15. The user may then gradually shift his weight over his feet by leaning further forward and/or by bearing down upon forwardly disposed portions of the armrests 26,27. Advantageously, as previously indicated, the armrests project sufficiently forwardly to provide substantial leverage to the user without a great deal of arm strength in pivoting the chair further in the forwardly inclined direction. The additional pivotal movement of the chair after the user's feet reach the floor elevates the user's torso so that less leg strength is required to reach a standing position. The foregoing leverage effect is further enhanced by the relatively low positions of the pivotal connections 32 between the mounting members 17,18 and 12,13.

Figure 4:
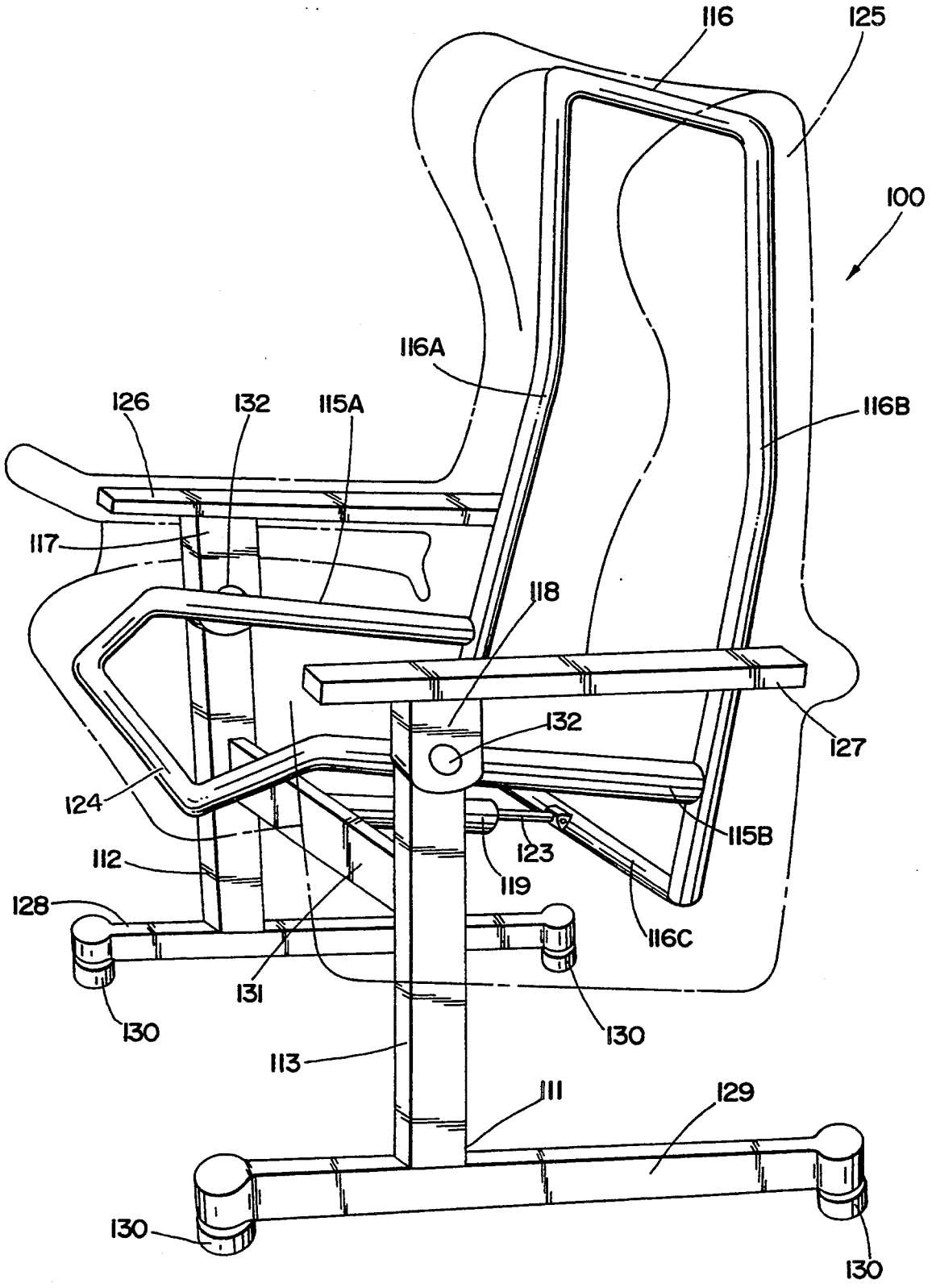
FIG. 4 is a perspective view of an orthopedic chair according to the present invention which is adapted for infirm and/or mentally disoriented users ("restraining chair"), and which is disposed in a relatively level position.
Figure 5:
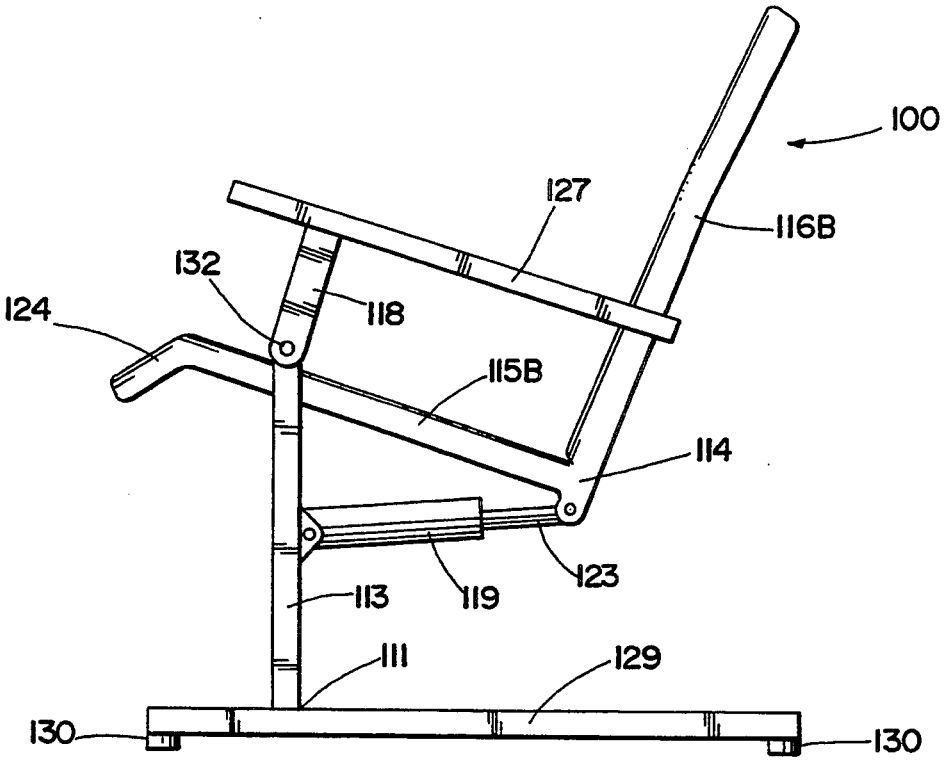
FIG. 5 is a diagrammatic, side elevational view, on a reduced scale, of the restraining chair illustrated in FIG. 4 and disposed in a reclined position.
Figure 6:
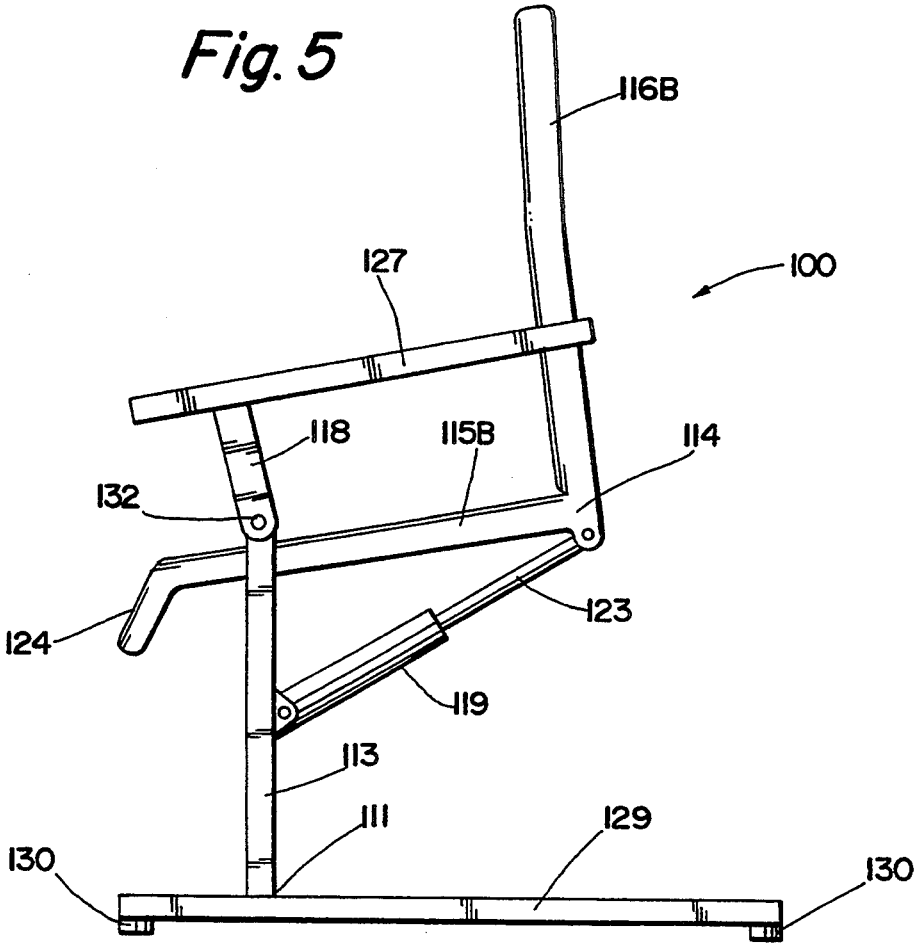
FIG. 6 is a side elevational view similar to FIG. 5 of the restraining chair in a forwardly inclined position.

As indicated in FIGS. 4–6, the present invention may take the form of a chair, generally designated 100, which is adapted for use by relatively infirm and/or mentally disoriented users ("restraining chair"). The subject restraining chair 100 basically comprises a ground-engaging chassis 111 formed with a pair of laterally spaced apart, upwardly projecting support members 112,113; a user-receiving frame 114 including a seat portion 115, a back portion 116, and a pair of laterally spaced apart mounting members 117,118; and a gas cylinder 119 extending between the chassis 111 and the frame 114. The mounting members 117 and 118 are pivotally mounted upon the support members 112 and 113, respectively, to permit the frame 114 to move between forwardly inclined, level and rearwardly inclined positions, and the gas cylinder 119 is disposed to limit acceleration of the frame as it moves between these positions.

The chassis 111 is formed from cast aluminum alloy and includes a pair of laterally spaced apart, longitudinally extending rails 128 and 129 to which the upwardly projecting support members 112 and 113, respectively, are rigidly connected. A transverse beam 131 extends between the vertical support members 112,113 and a base portion of the gas cylinder 119 is pivotally connected to said beam 131. Alternatively, a pair of laterally spaced apart cylinders may be mounted on the support members 112,113. Preferably, the support members 112, 113 are disposed relatively forwardly on the rails 128,129 in order to offset the relatively rearwardly disposed weight of the frame 114 and the user, as further explained herein. Floor-engaging feet 130 are disposed at opposite ends of each of the rails 128, 129.

The seat portion 115 of the frame 114 includes a pair of laterally spaced apart, tubular aluminum alloy members 115A and 115B which are welded or otherwise rigidly connected to lower portions of a pair of laterally spaced apart, generally upwardly extending tubular aluminum alloy back frame members 116A and 116B, respectively. The seat 115 includes a relatively downturned front portion 124. Relatively short portions of the back frame members 116A, 116B project below the attached ends of the seat frame members 115A, 115B, and a transverse tubular aluminum back frame member 116C extends between and is welded or otherwise rigidly connected to the lower ends of the generally vertical back frame members 116A, 116B. The piston end 123 of the gas cylinder 119 is attached to the transverse back frame member 116C.

The mounting members 117,118 are formed from cast aluminum alloy and are adapted to be pivotally and telescopically mounted at their lower ends upon upper ends of the support members 112, 113. Pivot pins 132 are mounted in aligned bores formed in the telescoping portions of the support members and mounting members. Relatively elongated, laterally spaced apart armrests 126,127 are welded or otherwise rigidly secured to the upper ends of the mounting members 117 and 118, respectively, and to the generally vertically extending back frame members 116A and 116B, respectively. Preferably, the armrests are formed from cast aluminum alloy and are covered, in a conventional manner, with cushioning material and fabric 125, as are the other elements of the user-receiving frame 114.

The pivotal connections 132 between the support members 112,113 and the mounting members 117,118 are disposed adjacent to the seat frame members 115A, 115B. In addition, said pivotal connections 132 are disposed closer to the downturned seat front 124 than to the back 116. Preferably, the seat 115 is supported entirely by the back 116, armrests 126,127 and mounting members 117,118. In effect, the seat, back and armrests are carried by the mounting members 117,118. Alternatively, however, the lateral seat frame members 115A, 115B may be pivotally mounted upon the support members 112, 113, or upon the pivot pins 132.

By providing the pivotal connections 132 relatively forwardly in relation to the seat frame, the present restraining chair 100 is biased towards rearwardly inclined positions. This bias is desirable because it makes egress from the chair more difficult for a mentally disoriented user, and thereby reduces or eliminates the perceived need for tethers or restraints. The user is simply unable to overcome the force of gravity and to position his weight sufficiently forwardly to overcome this bias and shift the chair into a forwardly inclined position.

The pivotal connections 132 are disposed at or slightly above the level of the seat frame in order to shorten the lever arm, i.e., the distance between the pivotal connections 132 and the center of gravity of the frame 114 with the user in it. In this manner, the amount of energy required to move the frame 114 from reclined positions to level and forwardly inclined positions is less than would be the case were the pivotal connections disposed substantially below the level of the seat frame. In the event that a gas spring is employed in place of the gas cylinder 119, the subject gas spring may be actuated to urge the frame towards a forwardly inclined position. By positioning the pivotal connections 132 adjacent to the seat frame, a smaller gas spring would be required than if the subject pivotal connections were disposed substantially lower.

The restraining chair is operated in the following manner. Typically, an assistant places the restraining chair 100 in a forwardly inclined position such as illustrated in FIG. 6, and assists the user in entering into the chair. If the user is able to stand, the assistant positions the chair so that the downturned front portion 124 is disposed in closed proximity to the calves of the user's legs and rear portions of the seat 115 and the back 116 are elevated to the level of the user's torso. The user is then assisted in bending at the knees and back until the torso contacts the seat 115. In accomplishing this movement, the user may be able to employ the armrests 126,127 to obtain some stability. The assistant then tilts the chair rearwardly until it is either level or slightly rearwardly inclined. In this position, the user and/or assistant is able to move the user's torso rearwardly in the restraining chair 100 to come in contact with and to be supported by the back 116 and rear portion of the seat 115. The user may be able to assist himself in this movement with the aid of the armrests 126,127. With the user's torso properly positioned at the rear of the chair, the piston 123 retracts into the gas cylinder 119, either as a result of the leverage created by the user or as a result of the assistant applying downward pressure to the back 116.

Having reached its fully reclined position, the restraining chair 100 is not easily returned to a level or forwardly inclined position by the user. The pivotal connections 132 are disposed so far forwardly relative to the user's torso that the user's center of gravity cannot be shifted forwardly of the pivotal connections without assistance. In addition, the reclined position of the frame 114 makes it difficult for the user to even move his torso forwardly on the seat.

In order to move the restraining chair to a level or forwardly inclined position, the assistant lifts the back 116 upwardly. Alternatively, a gas spring may be substituted for the present gas cylinder 119 and suitable conventional actuating mechanisms provided so that when the assistant actuates the gas spring, the restraining chair moves towards the forwardly inclined position. The use of a gas spring is particularly advantageous, as it frees the assistant to help the user out of the chair.

Thus, it may be seen that the present restraining chair 100, like the mobility chair 10, is adapted to move between forwardly inclined, level and reclined positions in a controlled manner, regardless of the position of the user therein. Likewise, the restraining chair facilitates the user's movement between standing and seated positions when it is forwardly inclined. In contrast to the mobility chair, however, the pivotal connections 132 on the restraining chair are located relatively forwardly, thereby biasing the restraining chair towards a reclined position to prevent a mentally disoriented user from leaving the subject chair without assistance.

While preferred embodiments of the present invention have been illustrated and described in some detail, the foregoing disclosure is not intended to unduly limit or restrict the scope of the following claims:

We claim:

1. A seating assembly comprising:

a) a ground-engaging chassis provided with a pair of laterally spaced apart, upwardly extending support members;

b) a user-receiving frame provided with a seat portion, a back portion and a pair of laterally spaced apart mounting members, said mounting members being pivotally connected to the support members, said frame being capable of being supported on said support members in one of a plurality of stable positions from a forwardly inclined position through a level position to a rearwardly inclined position; and c) a bidirectional damper extending between the frame and the chassis, said damper being capable of moderating the angular velocity of said frame as it moves between any one of said stable positions and any other of said stable positions.

2. The seating assembly according to claim 1, wherein said damper is capable of moderating the angular velocity of said frame to avoid jarring of a user as the frame reaches one of the fully inclined positions.

3. A seating assembly comprising:

a) a ground-engaging chassis provided with a pair of laterally spaced apart, upwardly extending support members and a rearwardly disposed transverse beam;

b) a user-receiving frame provided with a seat portion having a transverse brace depending therefrom, a back portion, a pair of laterally spaced apart armrests connected to opposite lateral sides of the back portion, and a pair of laterally spaced apart mounting members each connected to and extending downwardly from one of the armrests on opposite lateral sides of the seat portion approximately midway between the front end of said seat portion and the back portion of the frame and each pivotally connected to one of the support members substantially below the seat portion to permit the frame to move between a forwardly inclined position and a rearwardly inclined position, said seat portion and back portion of the frame being capable of moving as a unit between the forwardly inclined and rearwardly inclined positions, the front end of the seat portion being lower in the forwardly inclined position than in the rearwardly inclined position and the back portion being higher in the forwardly inclined position than in the rearwardly inclined position; and c) a gas cylinder connected at one end to said transverse beam on the chassis and at an opposite end to said transverse brace depending from the frame, said gas cylinder limiting acceleration of said frame as it moves between the forwardly inclined position and the rearwardly inclined position.

4. A seating assembly comprising:

a) a ground-engaging chassis provided with a pair of laterally spaced apart, upwardly extending support members;

b) a user-receiving frame provided with a seat portion, a back portion and a pair of laterally spaced apart mounting members, said mounting members being pivotally connected to the support members to permit the frame to be placed in one of a plurality of stable positions from a forwardly inclined position through a level position to a rearwardly inclined position; and c) a damper extending between the frame and the chassis for limiting acceleration of said frame as it moves between any one of said stable positions and any other of said stable positions.

5. The seating assembly according to claim 4, wherein a front end of the seat portion projects more forwardly relative to the chassis in the forwardly inclined position than in the rearwardly inclined position.

6. The seating assembly according to claim 4, wherein the pivotal connection of the mounting members to the support members is arranged to provide a substantial horizontal vector component in the arcuate movement of the user-receiving frame relative to the chassis.

7. The seating assembly according to claim 4, wherein said chassis is provided with a pair of laterally spaced apart rails and a transverse beam extending between rearwardly disposed portions of said rails, with one of said support members extending upwardly from each of said rails.

8. The seating assembly according to claim 4, wherein the damper comprises a gas cylinder.

9. The seating assembly according to claim 8, wherein the seat portion and back portion of the frame are capable of moving as a unit between the forwardly inclined and rearwardly inclined positions.

10. The seating assembly according to claim 9, wherein a front end of the seat portion is lower in the forwardly inclined position than in the rearwardly inclined position and the back portion is higher in said forwardly inclined position than in said rearwardly inclined position.

11. The seating assembly according to claim 10, wherein the front end of the seat portion is downturned.

12. The seating assembly according to claim 10, wherein the frame includes a pair of laterally spaced apart armrests connected to the back portion and mounting members.

13. The seating assembly according to claim 12, wherein the seat portion, the back portion and the armrests are carried by the mounting members.

14. The seating assembly according to claim 12, wherein the front portion of each of the armrests projects forwardly of the front end of the seat portion.

15. The seating assembly according to claim 12, wherein the mounting members are pivotally connected to the support members substantially below the seat portion.

16. The seating assembly according to claim 15, wherein the mounting members extend downwardly from the armrests and are disposed on opposite lateral sides of the seat portion approximately midway between the front end of said seat portion and the back portion of the frame.

17. The seating assembly according to claim 16, wherein the gas cylinder is connected at one end to a rearwardly disposed transverse beam on the chassis and at an opposite end to a transverse brace depending from the frame.

18. The seating assembly according to claim 12, wherein the mounting members are pivotally connected to the support members adjacent to the seat portion.

19. The seating assembly according to claim 18, wherein the mounting members extend downwardly from the armrests and are disposed on opposite lateral sides of the seat portion substantially closer to the front end of said seat portion than to the back portion of the frame.

20. The seating assembly according to claim 19, wherein the gas cylinder is connected at one end to a transverse beam connecting the support members and at an opposite end to the back portion of the frame.

21. The seating assembly according to claim 20, wherein the gas cylinder is provided with means to urge the frame towards the forwardly inclined position.

* * * * *